US005468321A

United States Patent [19]

van Liempt et al.

[11] Patent Number: 5,468,321

[45] Date of Patent: Nov. 21, 1995

[54] APPARATUS AND METHOD FOR JOINING TWO WEBS TOGETHER

[75] Inventors: Martinus J. C. van Liempt, Arnhem; Theodoor A. Buchmeyer, Eindhoven, both of Netherlands

[73] Assignee: Stork Contiweb B.V., Netherlands

[21] Appl. No.: 21,129

[22] Filed: Feb. 4, 1993

[30] Foreign Application Priority Data

Feb. 4, 1992 [NL] Netherlands ..... 9200199

[51] Int. Cl.[6] ..... B65H 69/06; B65H 21/00

[52] U.S. Cl. ..... 156/159; 156/157; 156/304.3; 156/505; 242/551; 242/553; 242/556.1

[58] Field of Search ..... 156/157, 159, 156/304.1, 304.3, 505, 506; 242/551, 553, 556.1

[56] References Cited

U.S. PATENT DOCUMENTS

| | | | |
|---|---|---|---|
| 2,987,108 | 6/1961 | Kilmartin . | |
| 3,554,842 | 1/1971 | Byrt | 156/505 |
| 3,719,542 | 3/1973 | Schmitz et al. . | |
| 3,939,031 | 2/1976 | Takimoto | 242/556.1 X |
| 4,120,739 | 10/1978 | Peeters et al. | 156/506 |
| 4,331,301 | 5/1982 | Martinez | 242/556.1 X |
| 5,318,646 | 6/1994 | Cardini et al. | 156/157 |

FOREIGN PATENT DOCUMENTS

| | | |
|---|---|---|
| 0263920 | 4/1988 | European Pat. Off. . |
| 2031297 | 11/1970 | France . |
| 2332115 | 6/1977 | France . |

OTHER PUBLICATIONS

Research Disclosure Nr. 201, Jan. 1981, Havant GB, pp. 19–20, "Means for Generating A Controlled Butt Splice Gap".

*Primary Examiner*—Mark A. Osele
*Attorney, Agent, or Firm*—Bell, Seltzer, Park & Gibson

[57] ABSTRACT

Apparatus and method for joining, while stationary, an expiring web to a new web in such a way that the joined webs lie in one plane. To this end, the new web and the expiring web are brought together and are simultaneously cut through along one cutting line. Subsequently, at least on one side, a bonding strip is applied over the web parts to be joined. The beam-shaped unit has a first contact surface for the new web. In line therewith and on the same side of the travel path, a second contact surface is arranged for the expiring web. That part of the new web which is located downstream of the cutting line, is situated at a distance from the expiring web. By retaining each of the web parts to be joined against an associated contact surface, it is possible to achieve an accurate join.

24 Claims, 6 Drawing Sheets

APPARATUS AND METHOD FOR JOINING TWO WEBS TOGETHER

Figure 1:
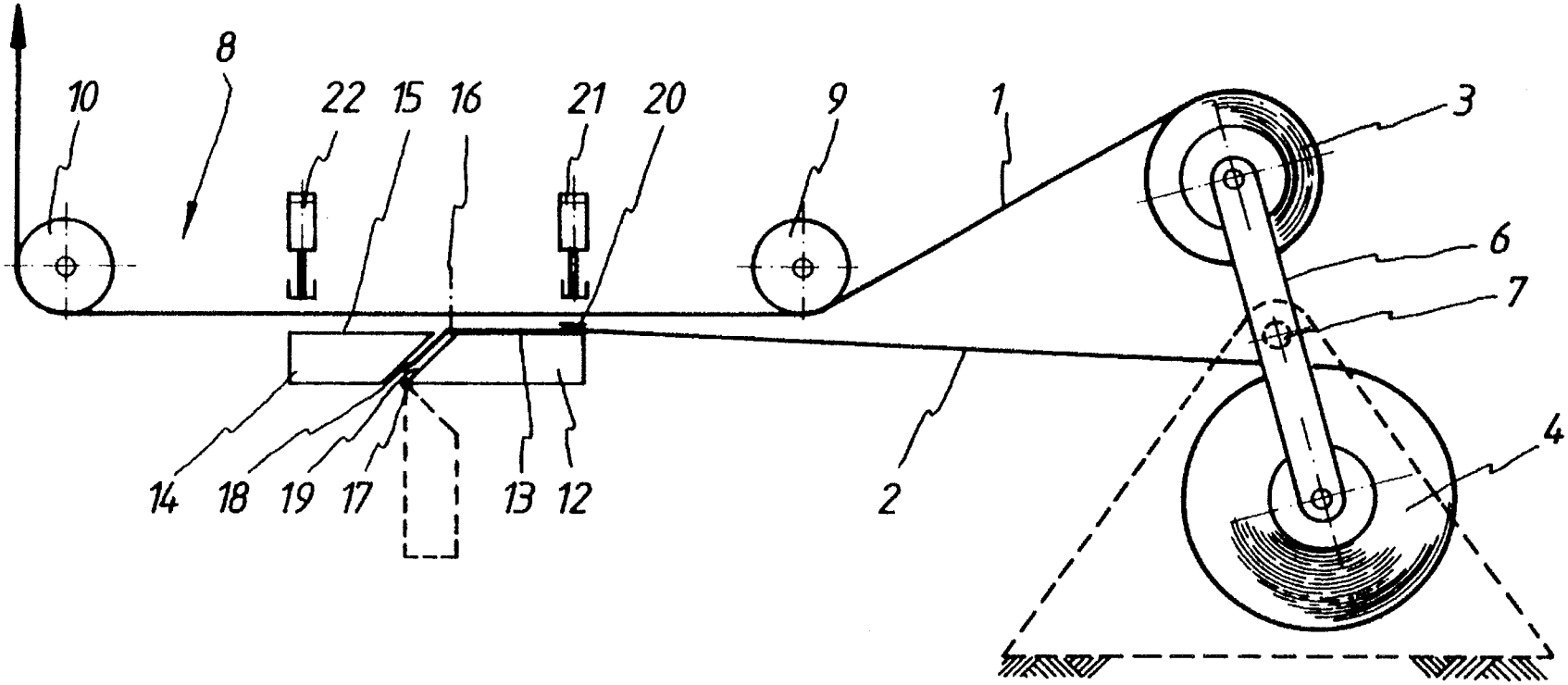

The present invention relates to an apparatus for joining, while stationary, an expiring web which undergoes a treatment or processing downstream of the apparatus to a new web, in such a way that, when they are joined, the webs lie in one plane, which apparatus at least comprises a travel path for the expiring web and, at least on one side of the travel path, a first beam unit which extends at least over the width of the expiring web, a part of the new web and a part of the expiring web being brought together abreast of the first beam unit, whereupon the two webs brought together are simultaneously cut through along one cutting line, and, on at least one side of the webs, a bonding strip being applied in order to join the webs, and the first beam unit having a first side which, at least during the cutting for a part, located upstream of the cutting line, of the new web forms a first contact surface, and the apparatus being provided with means for receiving a part, located downstream of the cutting line, of the new web, and with a second contact surface for that part of the expiring web which is located downstream of the cutting line. The present invention furthermore relates to a method of accomplishing such a join.

An apparatus of the abovementioned type is disclosed by U.S. Pat. No. 3 554 842 and is used, for example, in printing machines, in which the trailing end of a consumed roll of paper must be joined to the leading end of a new roll of paper. In order to prevent, as far as possible, a thickening of the web at the place of the join, the webs in this apparatus are joined in one plane. As a result, infeed problems are avoided in processing machines situated downstream of the apparatus.

In the known apparatus, the leading end of the new web is placed on the expiring web brought to a standstill, whereupon the two webs are clamped by clamping devices. It should be noted that processing generally continues while the join is made. To this end, downstream of the joining device, a supply of material of the expiring web is then held in, for example, a compensating-roller magazine, which then gradually gives up the material. As a result, the time available for making the join is limited. The known apparatus is provided with a beam unit which, on a first side, has a contact surface for the new web, and which, during cutting, presses the two webs against an anvil mounted in a fixed position in the apparatus. Incorporated approximately in the centre of that first side is a cutting device which comprises a knife blade extending in the longitudinal direction of the beam, while the anvil is provided with a resilient plastic part. After cutting, the beam unit is moved upwards and tilted, as a result of which a bonding strip, which is adhesive on one side and which is retained against a second side of the beam unit, is moved above the web border areas to be connected. In the abovementioned tilting movement, that part of the new web which is located downstream of the cutting line is carried along by the beam unit. By then pressing the beam unit downwards, the thin bonding strip is applied over the border areas to be connected. For the purpose of applying a second bonding strip to the other side of the webs, there is present, downstream of the beam unit, a rolling device which applies the second bonding strip while the web is fed through.

This known apparatus has the drawback that that part of the new web which is located upstream of the cutting line must be released, after cutting, from the contact surface on the first side of the beam unit in order that that part of the new web which is situated downstream of the cutting line can be removed for the purpose of applying the bonding strip over the web parts to be connected. This leads to inaccuracies in fitting together the web parts to be joined, and carries the risk of creasing and folding of the web part which has been released, which faults remain present when the bonding strip is applied and lead to a thick, inaccurate join. Furthermore, the two web border areas to be joined do not lie precisely in the same plane when the bonding strip is applied, as a result of which, particularly in the case of relatively thick webs, the bonding strip is not applied directly in the position ultimately required. There is also the risk of that part of the old web which is located upstream of the cutting line also bonding to the bonding strip. Finally, applying the second bonding strip by means of the rolling device has the drawback that the expiring web is then in motion, as a result of which accurate synchronisation is required, and there is also the disadvantage that the join is being stressed at the moment that only one bonding strip has been applied.

The object of the invention is to provide an apparatus and method which overcome the abovementioned drawbacks.

This object is achieved by providing an apparatus wherein the means for receiving that part of the new web which is located downstream of the cutting line are positioned in such a way that that part of the new web which is located downstream of the cutting line is situated, at least during cutting, at least in an area near the cutting line, at a distance from that part of the expiring web which is located downstream of the cutting line, and the apparatus is provided, on the same side of the travel path as the first beam unit, with a contact element which comprises the second contact surface for that part of the expiring web which is located downstream of the cutting line, the second contact surface being essentially in line with the first contact surface while the join is accomplished.

This provides the advantage that, in addition to that part of the new web which lies against the first contact surface, that part of the expiring web which is to be joined thereto and which is situated downstream of the cutting line can also be retained against a second contact surface on the same side of the travel path during the entire process. As a result, the application of a bonding strip no longer requires the release of one of said web parts to be joined from the associated contact surface so that a web part which has been cut loose and which does not have to be joined to another web part can be removed. Moreover, when a bonding strip is applied, there is now no web part present between the web parts to be joined and the associated contact surfaces. This prevents possible faults when the join is being made and also provides the possibility of retaining the two web parts to be joined in their ultimately required position during the entire process.

Preferably, the means for receiving that part of the new web which is located downstream of the cutting line are linked to the first beam unit. It is also possible, however, to incorporate these means as a separate component in the apparatus, in which case this component, for the purpose of placing the new web, can be movable.

In a particular advantageous embodiment the contact element is also linked to the first beam unit.

Particularly preferably, the contact element is movably linked to the first beam unit. In this case, the contact element may be linked to the first beam unit so as to be, for example, pivotable or slidable, which facilitates the placing of that part of the new web which is located downstream of the cutting line on the first beam unit when preparing for the join. Moreover, clamping of said web part can easily be achieved in this way.

It is advantageous to design the apparatus in such a way that the first contact surface and the second contact surface lie accurately in one plane, at least while the join is being accomplished. As a result, the web parts to be joined are brought directly into the ultimately required position and joined to one another.

Likewise, the apparatus is preferably provided with means for retaining the expiring web against the second contact surface and for retaining the new web against the first contact surface. These may be conventional means such as, for example, vacuum suction devices, or grippers at the lateral edges of the webs.

Providing the apparatus with means for retaining that part of the new web which is located downstream of the cutting line ensures that this web part cannot interfere with the accomplishment of join, for example by adhering to the bonding strip.

It is further advantageous to provide the first beam unit on its first side with a slot to let a cutting device pass through.

In a particular embodiment of the apparatus according to the invention the first beam unit is tiltable at least into a first position for placing the new web and a second position for cutting the webs and applying a bonding strip over the webs.

In another embodiment, there is disposed within the first beam unit a cutting device, which comprises at least a head with a rotatable round knife blade which, on the first side of the first beam unit, partially projects outwards through a slot, and a drive mechanism which moves the head in a sliding motion along the cutting line.

In a preferred embodiment of the apparatus according to the invention, opposite the first beam unit, which is designed to receive the new web, and on the other side of the travel path, a second beam unit is present which, on a first side is provided with a slot to let a cutting device pass through and on a second side is provided with means for receiving a bonding strip, and which is tiltable into a first position for placing a bonding strip thereon, a second position for cutting the webs and a third position for applying the bonding strip to the webs. This apparatus makes it possible to apply, on one side, a bonding strip over the web parts to be joined, while the new web is always fed in from the same side of the expiring web.

In another preferred embodiment of the apparatus the first beam unit is provided, on a second side, with means for receiving a bonding strip and is tiltable into a first position for placing a bonding strip thereon, a second position for placing the new web and a third position for cutting the webs. An apparatus of this type makes it possible to accomplish, at will, a join in which a bonding strip is present on one side or both sides of the web parts to be joined. In this embodiment the new web is likewise fed into the apparatus from the same side of the expiring web.

In a following preferred embodiment the first beam unit is provided, on a second side, with means for receiving a bonding strip and with a slot for letting a cutting device pass through, a second beam unit whose construction is identical to that of the first beam unit being present opposite the first beam unit on the other side of the travel path, and both beam units being tiltable into a first position for placing a bonding strip thereon, a second position for placing the new web and a third position for cutting the webs. By means of this apparatus, a bonding strip can, if desired, be applied to two sides of the web parts to be joined, it being possible always to feed in the new web from another side of the expiring web. This is important, for example, when the apparatus is used in installations, where the magazine rolls remain in a fixed position.

It is advantageous to incorporate each beam unit in the apparatus in such a way, that its longitudinal axis is perpendicular to the travel path, and to dispose the slot or slots in each beam unit for letting a cutting device pass through at an angle to its longitudinal axis. A join which is positioned obliquely across the expiring web generally runs smoothly through processing machines downstream of the joining apparatus.

By providing the apparatus with a mechanism which is able to move each beam unit from a working position in which the join is accomplished to a preparatory position for placing a bonding strip and/or placing a new web, the preparatory position being upstream of the working position, it is readily possible to place the new web and bonding strips on the beam units, so that there is no need to work near the rapidly moving expiring web when the join is being prepared, and there is enough workspace for the operating personnel. On the other hand, in the case of apparatus for joining narrow webs it may also be possible to carry out the preparatory operations from the lateral edge of the web.

Preferably, for applying a bonding strip to two sides of the web the apparatus is provided with a feed device for feeding a bonding strip from a preparatory position in which the bonding strip is placed by the operating personnel on the feed device, to a beam unit which, prior to cutting the new and the expiring webs, is covered by the expiring web. As a result, a bonding strip, which had previously been placed on the feed device can be brought to the beam unit, which is difficult to reach prior to cutting, without any loss of time being caused thereby, for example as a result of then also placing a bonding strip on the beam unit.

In an advantageous embodiment, the feed device comprises a beam element which extends at least over the width of the expiring web and which has two essentially parallel sides, at least one side being provided with a vacuum suction device for receiving a bonding strip, and a travel mechanism for displacing the beam element. By using this feed device in combination with the previously mentioned apparatus with two beam units and cutting devices incorporated therein, it is possible to accomplish a join with two bonding strips in a very short time, for example in 6 seconds.

The apparatus may be provided with an unrolling device for placing, in the preparatory position, bonding strip material, which is supplied on a roll, on the beam units and/or the feed device.

The exclusive right applied for also includes a method for accomplishing a join of this type with the aid of one or two bonding strips.

Figure 2:
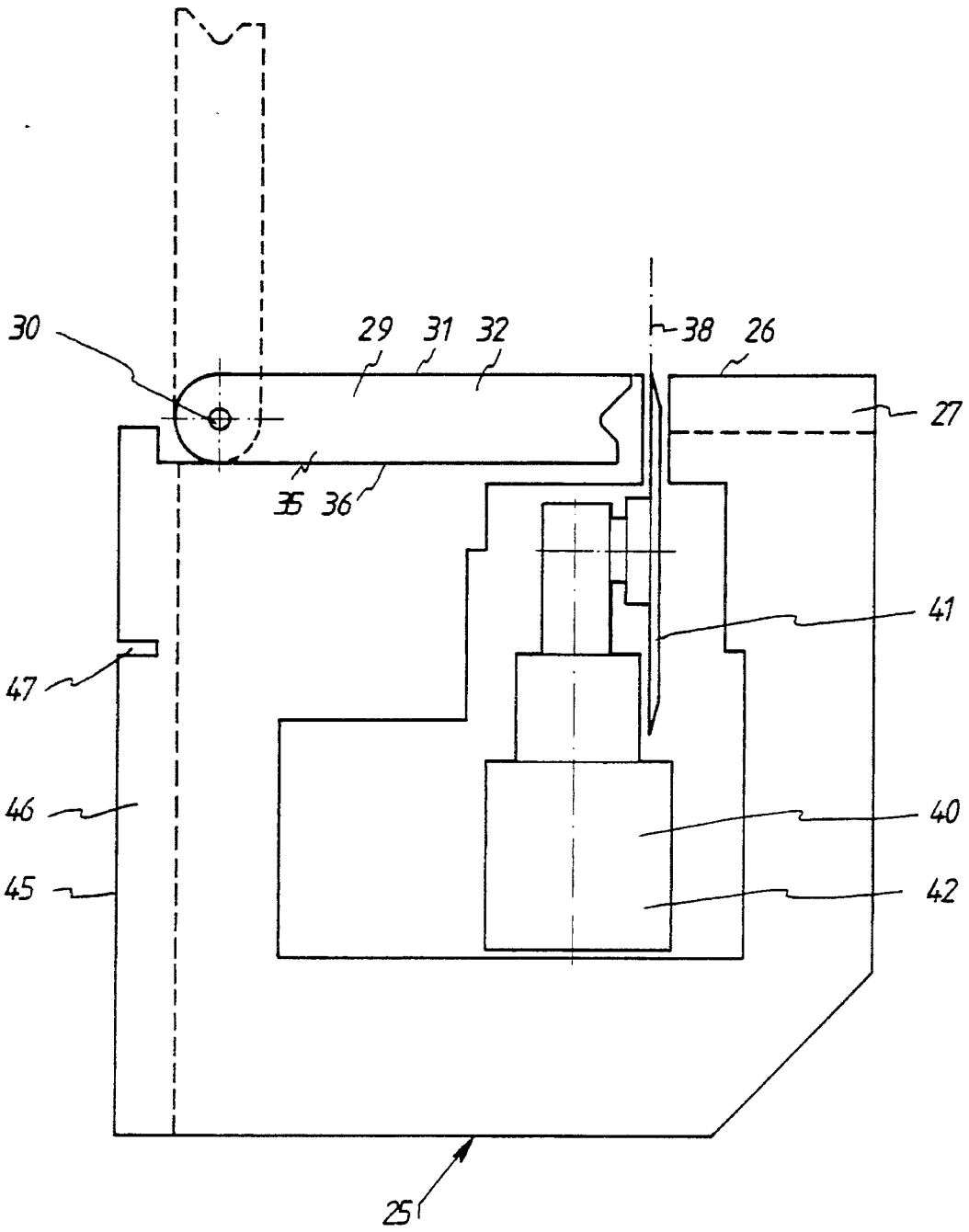
Figure 3:
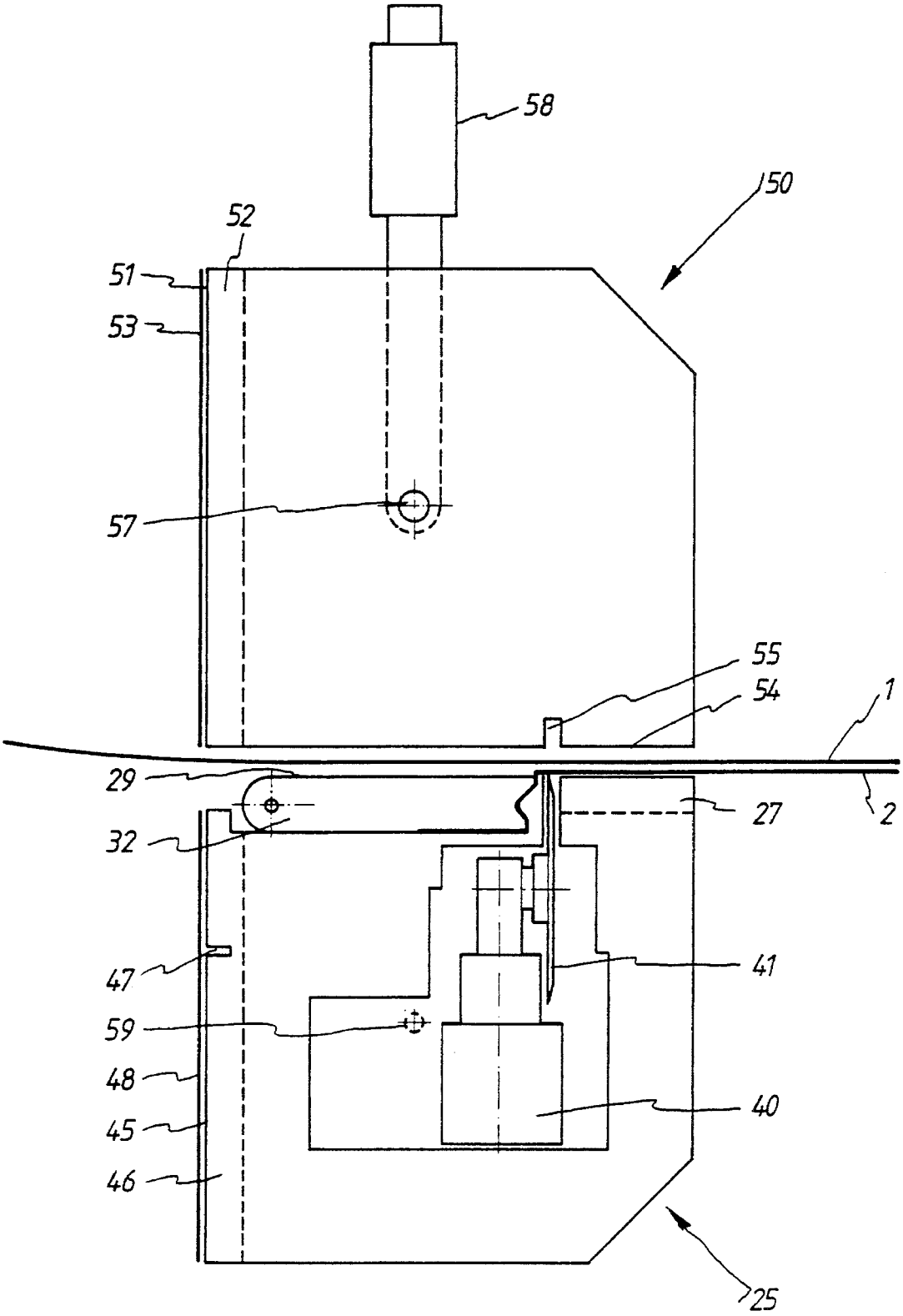
Figure 4:
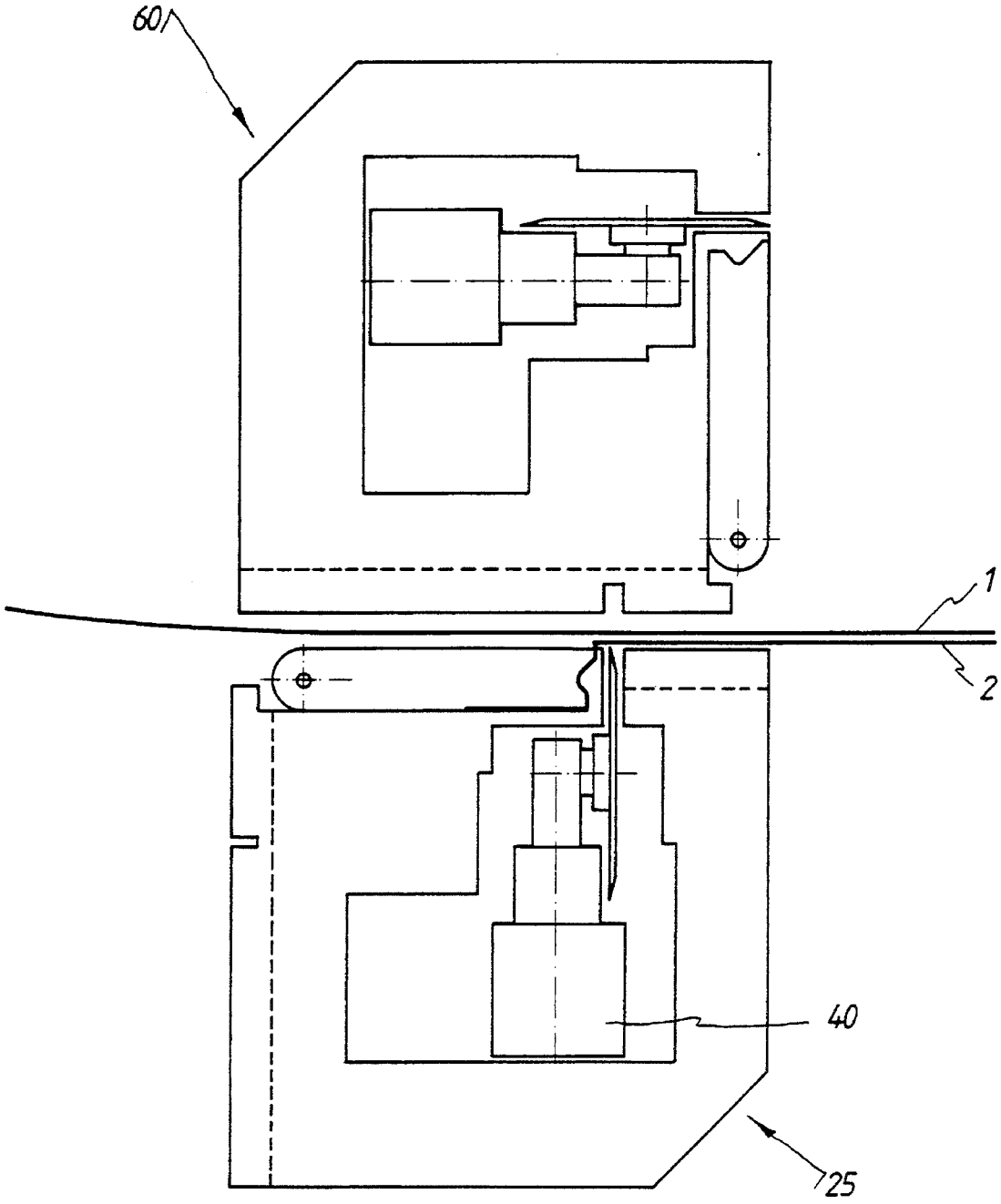

The invention is described hereinafter in more detail with reference to the drawing of several illustrative embodiments, in which:

FIG. 1 shows a diagrammatic side view of an application of an embodiment of the apparatus according to the invention, FIG. 2 shows, in diagrammatic form, a cross section of an embodiment of a beam unit according to the invention, FIG. 3 shows, in diagrammatic form, another embodiment of the apparatus: according to the invention, FIG. 4 shows, in diagrammatic form, yet another embodiment of the apparatus according to the invention, and FIG. 5*a*–5*f* show, in diagrammatic form, various stages of a join being accomplished of a new web to an expiring web with the aid of the apparatus from FIG. 4.

FIG. 1 illustrates an application of an apparatus for joining an expiring web 1 to a new web 2, a bonding strip being applied to one side. The webs 1, 2 come from magazine rolls 3, 4, respectively. The magazine rolls 3, 4 are held in a yoke 6 which can be tilted about a shaft 7, enabling the new magazine roll 4 always to be installed in the same place. As a result, the new web 2 is always fed into the apparatus on the same side of the expiring web 1. Guide rollers 9, 10 form a travel path 8 for the expiring web 1. The apparatus is furthermore provided with a beam unit 12, which has a first contact surface 13 for that part of the new web 2 which is located upstream of the cutting line 16. A contact element 14, which is placed in a fixed position in the apparatus, has a second contact surface 15 for that part of the expiring web 1 which is located downstream of the cutting line. The cutting line 16 runs between the contact surfaces 13, 15. The beam unit 12 is tiltable about a shaft 17 in the position indicated by dashed lines. In order to accomplish the join, the leading end of the new web 2 is brought up against the downward-folded beam unit 12, that part of the new web 18 which is located downstream of the cutting line being brought up against contact surface 19. With the aid of a separate thin clamping strip 20, the new web 2 is held against the first contact surface 13. The expiring web, which has already been brought to a standstill, is clamped with the aid of clamping devices 21, 22, for example pneumatic cylinders, against the beam unit 12, once more folded upwards, and the contact element 14, respectively. By now moving a cutting device (possibly by hand) along cutting line 16, the two webs 1, 2 are cut through simultaneously. By lifting the clamping device 21, it is possible to retract that part of the expiring web 1 which is located upstream of the cutting line, whereupon a bonding strip can be applied over the webs to be joined, for example by means of a hand roller. After lifting the clamping device 22 and removing the clamping strip 20, the expiring web 1 is brought up to speed again.

FIG. 2 shows a beam unit 25 according to the invention which has a first contact surface 26. For the purpose of retaining a new web against this contact surface 26, a vacuum suction device 27 is present. A contact element 29 is linked to the beam unit 25, so as to be pivotable about shaft 30, and can be tilted into the position indicated by dashed lines. The contact element 29 comprises a second surface 31 for an expiring web and a vacuum suction device 32 associated therewith. The bottom surface of cavity 35, which, in the down-folded position of the contact element 29, receives said contact element, forms a contact surface 36 for that part of a new web which is located downstream of the cutting line. By folding the contact element 29 upwards, a new web can be brought up against the contact surface 36 in a simple manner, whereupon, as a result of folding down the contact element 29, that part of said new web which is located downstream of the cutting line is clamped firmly. The beam unit 25 is furthermore provided with a cutting device 40, comprising a rotatable round knife blade 41 which is moved along cutting line 38 by means of a travel mechanism 42, for example a cylinder without a piston rod. In the rest position, the knife blade 41 is outside the range of the webs. The beam unit 25 is provided, on a second side 45, with a vacuum suction device 46 for receiving a bonding strip. If required, the beam unit 25 may also be provided with a slot 47 on the second side 45 for letting a cutting device pass through.

FIG. 3 illustrates the expiring web 1, the new web 2 and the first beam unit 25, which corresponds to the beam unit from FIG. 2. Disposed opposite the beam unit 25 is a second beam unit 50 which, on a first side 51, is provided with a vacuum suction device 52 for receiving a bonding strip 53. Disposed on a second side 54 is a slot 55 for letting the knife blade 41 of the cutting device 40 of the first beam unit 25 pass through. The second beam unit 50 can be tilted about a shaft 57 positioned in a longitudinal direction and can be moved up and down by means of travel mechanism 58, for example a pneumatic cylinder, while the first beam unit 25 can similarly be tilted about a shaft 59 positioned in a longitudinal direction.

The apparatus illustrated in FIG. 3 can be used as required to accomplish a join in which a bonding strip is present on one side or both sides of the web parts 1,2 to be joined.

In order to accomplish a join having a bonding strip on both sides, the first beam unit 25 is first tilted to the right, from the position shown, through 180° for the purpose of placing bonding strip 48 on the second side 45. The first beam unit 25 is then tilted to the left through 90° for the purpose of placing the new web 2, as described in the case of FIG. 2. Finally, the beam unit 25 is again tilted through 90° to the left. Also bonding strip 53 is placed on the second beam unit 50, which completes the preparation. After the expiring web 1 has been brought to a standstill, the second beam unit 50 is moved downwards by the travel mechanism 58 against the first beam unit 25. By operating vacuum suction devices 27, 32, the web parts to be joined are firmly retained against the first beam unit 25. The cutting device 40 is then operated, and the knife blade 41 simultaneously cuts through the webs 1, 2. In this process, the knife blade 41 passes through the slot 55. Subsequently, the second beam unit 50 is moved slightly upwards, which makes it possible to remove that part of the expiring web 1 which has been cut loose and which is located upstream of the cutting line, while the web parts to be joined are still firmly retained. By tilting the second beam unit 50, bonding strip 53 is brought above the web parts to be joined and subsequently, by moving said beam unit 50 downwards, it is applied to the webs to be joined.

In order to apply the second bonding strip 48, the vacuum suction device 52 remains operative, while the vacuum suction devices 27, 32 are switched off. After the second beam unit 52 is moved slightly upwards, in which process the webs 1, 2 are carried along, the first beam unit 25 is tilted to the right through 90°. By now moving the second beam unit 50 downwards, bonding strip 48 is applied. Finally, the vacuum suction devices 45 and 52 are switched off, and the second beam unit 50 is moved upwards, whereupon the expiring web 1 is again brought up to speed.

FIG. 4 illustrates another embodiment of an apparatus according to the invention, for joining the new web 2 to the expiring web 1. To this end, a second beam unit 60, which is of identical construction to the first beam unit 25, except for its construction being mirror-symmetrical is present opposite the first beam unit 25, which corresponds to the beam unit 25 from FIG. 2. This apparatus makes it possible to feed the new web 2 from both sides of the expiring web 1, and if required, a bonding strip can be applied to one side or both sides of the web parts 1,2 to be joined. This is required in installations where magazine rolls do not change position.

The FIGS. 5*a–f* illustrate in diagrammatic form an apparatus according to the invention in various stages of the accomplishment of a join. To this end, the apparatus is provided with a first beam unit 25 and, located opposite thereto, a second beam,shaped unit 60, both corresponding to FIG. 4. The beam units 25, 60 each can be moved by a travel-mechanism (not shown) from a working position, indicated as A, to a preparatory position, indicated as B. The apparatus has a travel path which is formed by guide rollers 100, each of which is linked to one of the beam units 25, 60, and pinching rollers 105, which are incorporated in the apparatus. The pinching rollers 105 can be moved towards one another in order to bring the expiring web 1 to a standstill, and they rotate, after having achieved standstill, through a small angle against the feed-through direction in order to remove the web tension from that part of the expiring web 1 which is located upstream of the pinching rollers. Also shown in diagrammatic form are a feed device 110 and an unrolling device 120. Of the feed device 110, only the beam element is shown. Here the beam element is provided on one side with a resilient rubber part which, seen in the feed-through direction, is spherical in the unloaded state, and with a vacuum suction device by means of which a bonding strip can be retained against the rubber part.

Figure 5A:
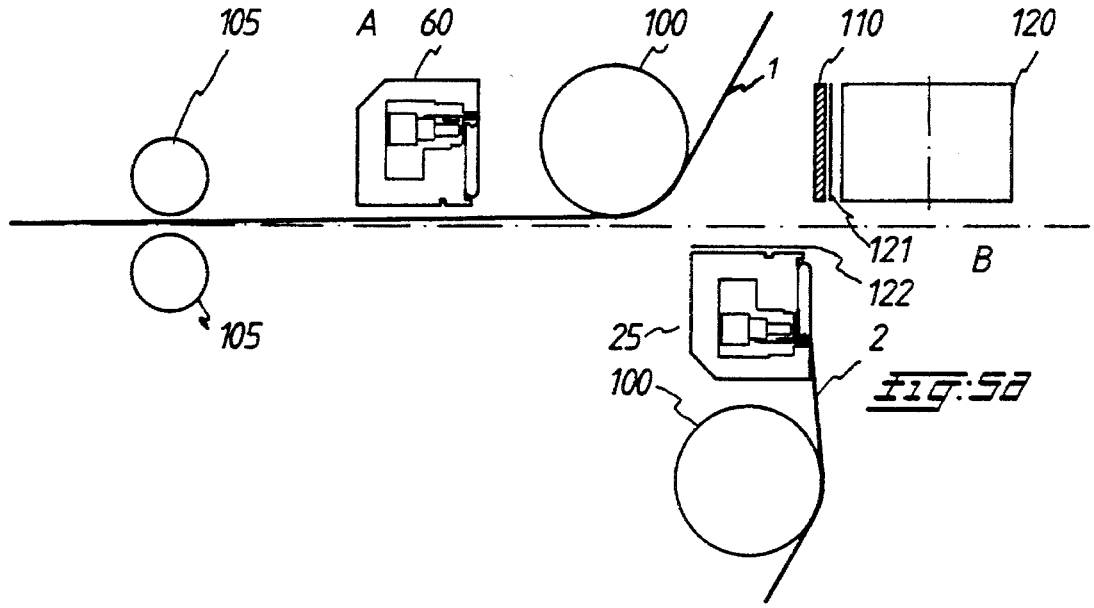

FIG. 5*a* shows the apparatus at the time when preparations for making a join are completed. With the aid of the unrolling device 120, a bonding strip 121 has been placed on the feed device 110, and a bonding strip 122 has been placed on the first beam unit 25. Also the leading end of the new web 2 has been attached to the first beam unit 25.

Figure 5B:
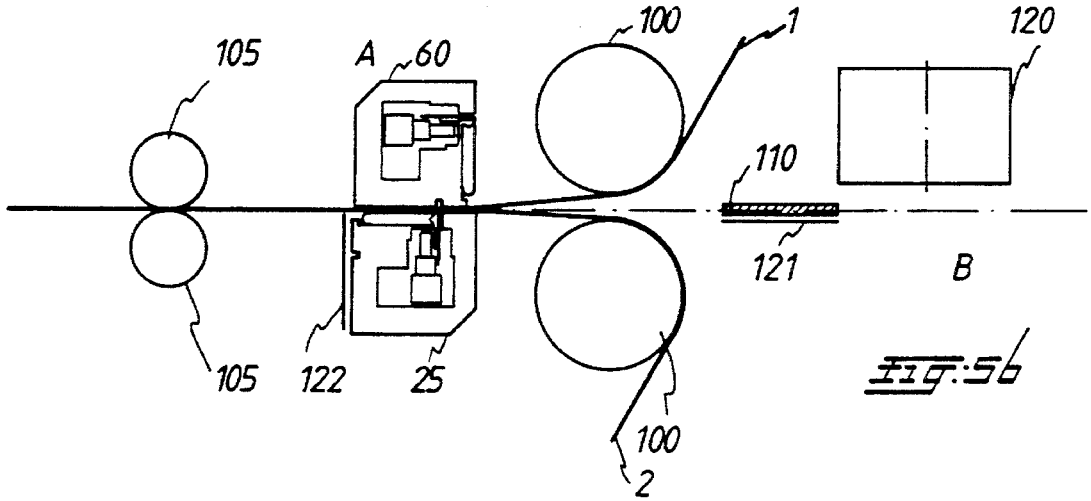

FIG. 5*b* shows the apparatus at the instant when the two webs 1,2 are being cut. As can be seen from the Figure, the pinching rollers 105 are pressed together, as a result of which the expiring web 1 has been brought to a standstill. By operating vacuum suction devices in the first beam unit 25, that part of the expiring web 1 which is located downstream of the cutting line, and that part of the new web 2 which is located upstream of the cutting line are firmly retained.

Figure 5C:
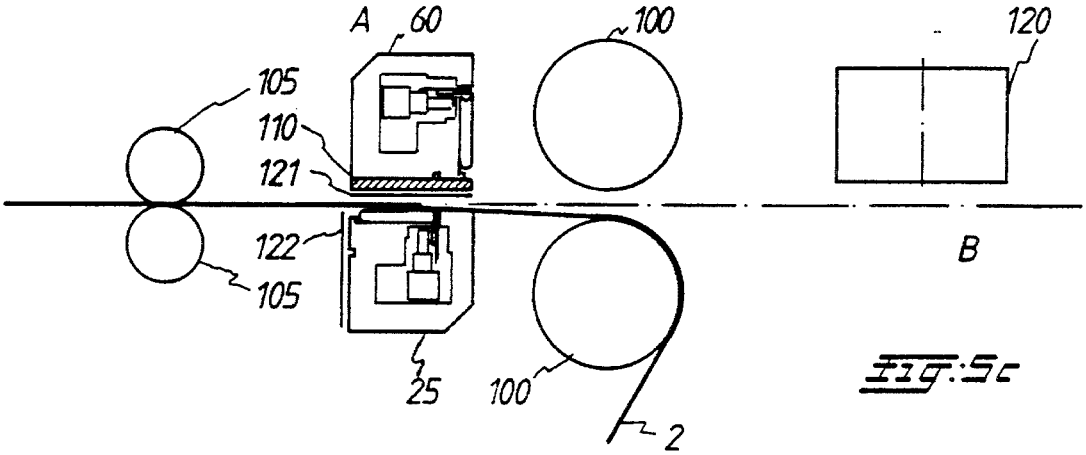

In FIG. 5*c*, that part of the expiring web 1 which has been cut loose and which is located upstream of the cutting line has already been retracted and the feed device 110 has been brought into working position A. By now moving the second beam unit 60 downwards, the bonding strip 121 is applied over the webs to be joined. Because the rubber part of the feed device is spherical in the unloaded state, the result is achieved that, owing to the gradual flattening of the rubber part, the bonding strip is pressed onto the web parts to be joined from its centre towards the lateral edges, which prevents the formation of blisters under the bonding strip.

Figure 5D:
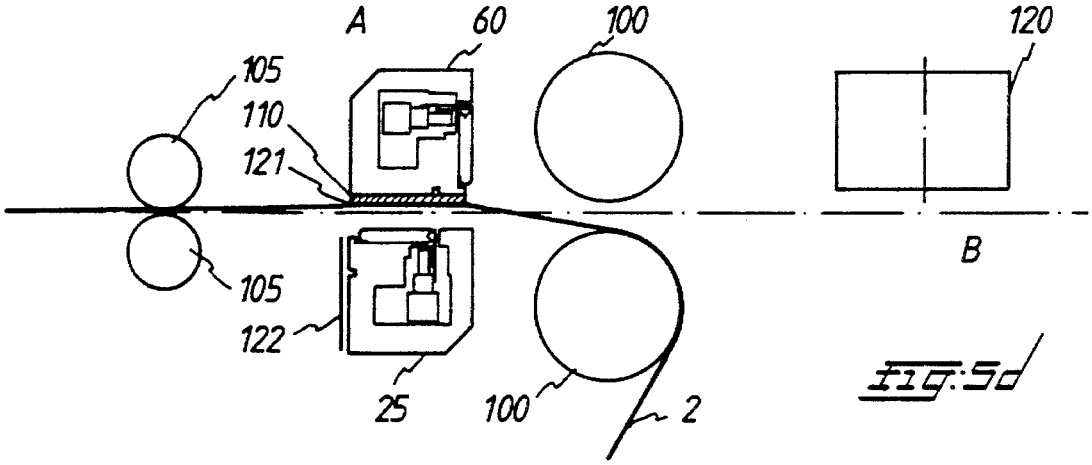

In FIG. 5*d*, the first bonding strip 121 has been applied. By moving the second beam unit 60 upwards, the feed device 110 and the already joined webs are carried along, which provides room for tilting the first beam unit 25.

Figure 5E:
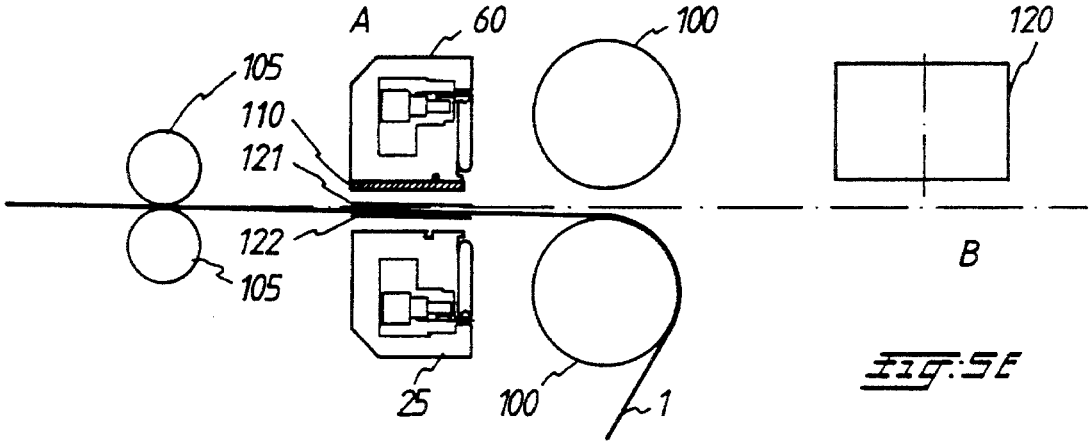

In FIG. 5*e*, the second bonding strip 122 has also been applied, whereupon the web is released by the beam units 25,60. Thereafter, the new expiring web 1 can be brought up to speed again, additional pressure being applied, if necessary, to the join by the pinching rollers 105.

Figure 5F:
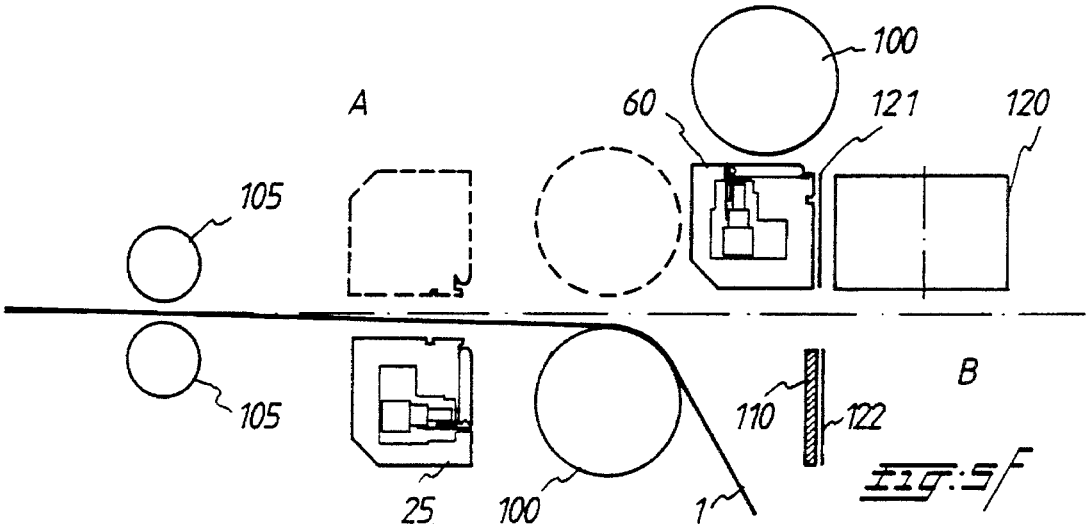

FIG. 5*f* illustrates the apparatus after the bonding strip 121 has been placed on the beam unit 60 and bonding strip 122 on the feed device 110 for the purpose of making the next join. It should be noted that the new web following hereafter is now fed in from the other side.

Using the apparatus shown in FIG. 5, it is possible to accomplish a join in about six seconds after the preparation.

We claim:

1. Apparatus for joining, while stationary, an expiring web which undergoes a treatment or processing downstream of the apparatus to a new web, in such a way that, when they are joined, the webs lie in one plane, which apparatus at least comprises a travel path for the expiring web and, at least on one side of the travel path, a first beam unit which extends at least over the width of the expiring web, a part of the new web and a part of the expiring web being brought together abreast of the first beam unit, whereupon the two webs brought together are simultaneously cut through along one cutting line, and on at least one side of the webs a bonding strip being applied in order to join the webs, and the first beam unit having a first side which, at least during the cutting for a part, located upstream of the cutting line, of the new web forms a first contact surface, and the apparatus being provided with means for receiving a part, located downstream of the cutting line, of the new web, and with a second contact surface for that part of the expiring web which is located downstream of the cutting line, wherein the means for receiving that part of the new web which is located downstream of the cutting line are positioned in such a way that that part of the new web which is located downstream of the cutting line is situated, at least during cutting, at least in an area near the cutting line, at a distance from that part of the expiring web which is located downstream of the cutting line, and the apparatus is provided, on the same side of the travel path as the first beam unit, with a contact element which comprises the second contact surface for that part of the expiring web which is located downstream of the cutting line, the second contact surface being essentially in line with the first contact surface while the join is accomplished, the apparatus further being provided with means for retaining the expiring web against the second contact surface and for retaining the new web against the first contact surface while the part of the expiring web which is located upstream of the cutting line is removed and the bonding strip is applied on the side of the web parts to be joined opposite the first and second contact surfaces.

2. Apparatus according to claim 1, wherein the means for receiving that part of the new web which is located downstream of the cutting line are linked to the first beam unit.

3. Apparatus according to claim 2, wherein the contact element is linked to the first beam unit.

4. Apparatus according to claim 3, wherein the contact element is movably linked to the first beam unit.

5. Apparatus according to claim 1, wherein the first contact surface and the second contact surface, lie accurately in one plane, at least while the join is being accomplished.

6. Apparatus according to claim 1, wherein the apparatus is provided with means for retaining that part of the new web which is located downstream of the cutting line.

7. Apparatus according to claim 1, wherein the first beam unit on its first side is provided with a slot to let a cutting device pass through.

8. Apparatus according to claim 7, wherein the longitudinal axis of each beam unit is perpendicular to the travel path, and the slot or slots in each beam unit for letting a cutting device pass through are disposed at an angle to the longitudinal axis of the beam unit.

9. Apparatus according to claim 1, wherein the first beam unit is tiltable at least into a first position for placing the new web and a second position for cutting the webs and applying a bonding strip over the webs.

10. Apparatus according to claim 1, wherein there is disposed within the first beam unit a cutting device, which comprises at least a head with a rotatable round knife blade which, on the first side of the first beam unit, partially projects outwards through a slot, and a drive mechanism which moves the head in a sliding motion along the cutting line.

11. Apparatus according to claim 10, wherein the first beam unit is provided, on a second side, with means for receiving a bonding strip and with a slot for letting a cutting device pass through, and in that a second beam unit whose construction is identical to that of the first beam unit is present opposite the first beam unit on the other side of the travel path, and both beam units are tiltable into a first position for placing a bonding strip thereon, a second position for placing the new web and a third position for cutting the webs.

12. Apparatus according to claim 1, wherein opposite the first beam unit, which is designed to receive the new web, and on the other side of the travel path a second beam unit is present which, on a first side is provided with a slot to let a cutting device pass through and on a second side is provided with means for receiving a bonding strip, and which is tiltable into a first position for placing a bonding strip thereon, a second position for cutting the webs and a third position for applying the bonding strip to the webs.

13. Apparatus according to claim 12, wherein a feed device is provided for feeding a bonding strip from a preparatory position in which the bonding strip is placed on the feed device to a beam unit which, prior to cutting the new and the expiring webs, is covered by the expiring web.

14. Apparatus according to claim 13, wherein the feed device at least comprises a beam element which extends at least over the width of the expiring web and which has two essentially parallel sides, at least one side being provided with a vacuum suction device for receiving a bonding strip, and a travel mechanism for displacing the beam element.

15. Apparatus according to claim 12, wherein the first beam unit is provided, on a second side, with means for receiving a bonding strip and is tiltable into a first position for placing a bonding strip thereon, a second position for placing the new web and a third position for cutting the webs.

16. Apparatus according to claim 1, wherein the apparatus is provided with a mechanism which is able to move each beam unit from a working position in which the join is accomplished to a preparatory position for placing a bonding strip and/or placing a new web, the preparatory position being upstream of the working position.

17. Apparatus according to claim 16, wherein the apparatus is provided with an unrolling device for placing, in the preparatory position, bonding strip material, which is supplied on a roll, on the beam units and/or the feed device.

18. Method of joining an expiring web to a new web in such a way that, when they are joined, the webs lie in one plane, a part of the new web being brought into contact with the expiring web, both webs simultaneously being cut through along one cutting line, and a bonding strip being applied to at least one side of the webs for the purpose of joining the webs, the method comprising the steps of:

retaining the new web upstream of the cutting line, at least during cutting and application of the bonding strip, against a first contact surface, prior to cutting, placing the new web downstream of the cutting line, at least in an area near the cutting line, at a distance from the expiring web, positioning the expiring web downstream of the cutting line against a second contact surface, which lies on the same side of the expiring web as the first contact surface and in line with the first contact surface, retaining the expiring web, at least during cutting and application of the bonding strip against the second contact surface, cutting both the webs simultaneously along the cutting line, removing the expiring web upstream of the cutting line, and applying the bonding strip over those parts of the new and expiring webs which are located along the cutting line on the side of the webs opposite the first and second contact surfaces.

19. Method according to claim 18, wherein a bonding strip is likewise applied to the other side of the webs.

20. Apparatus for joining, while stationary, an expiring web which undergoes a treatment or processing downstream of the apparatus to a new web, in such a way that, when they are joined, the webs lie in one plane, which apparatus at least comprises a travel path for the expiring web and, at least on one side of the travel path, a first beam unit which extends at least over the width of the expiring web, a part of the new web and a part of the expiring web being brought together abreast of the first beam unit, whereupon the two webs brought together are simultaneously cut through along one cutting line, and on at least one side of the webs a bonding strip being applied in order to join the webs, and the first beam unit having a first side which, at least during the cutting for a part, located upstream of the cutting line, of the new web forms a first contact surface, and the apparatus being provided with means for receiving a part, located downstream of the cutting line, of the new web, and with a second contact surface for that part of the expiring web which is located downstream of the cutting line, wherein the means for receiving that part of the new web which is located downstream of the cutting line are positioned in such a way that that part of the new web which is located downstream of the cutting line is situated, at least during cutting, at least in an area near the cutting line, at a distance from that part of the expiring web which is located downstream of the cutting line, and the apparatus is provided, on the same side of the travel path as the first beam unit, with a contact element which comprises the second contact surface for that part of the expiring web which is located downstream of the cutting line, the second contact surface being essentially in line with the first contact surface while the join is accomplished, and wherein the first beam unit being tiltable at least into a first position for placing the new web and a second position for cutting the webs and applying a bonding strip over the webs.

21. Apparatus for joining, while stationary, an expiring web which undergoes a treatment or processing downstream of the apparatus to a new web, in such a way that, when they are joined, the webs lie in one plane, which apparatus at least comprises a travel path for the expiring web and, at least on one side of the travel path, a first beam unit which extends at least over the width of the expiring web, a part of the new web and a part of the expiring web being brought together abreast of the first beam unit, whereupon the two webs brought together are simultaneously cut through along one cutting line, and on at least one side of the webs a bonding strip being applied in order to join the webs, and the first beam unit having a first side which, at least during the cutting for a part, located upstream of the cutting line, of the new web forms a first contact surface, and the apparatus being provided with means for receiving a part, located downstream of the cutting line, of the new web, and with a second contact surface for that part of the expiring web which is located downstream of the cutting line, wherein the means for receiving that part of the new web which is located downstream of the cutting line are positioned in such a way that that part of the new web which is located downstream of the cutting line is situated, at least during cutting, at least in an area near the cutting line, at a distance from that part of the expiring web which is located downstream of the cutting line, and the apparatus is provided, on the same side of the travel path as the first beam unit, with a contact element which comprises the second contact surface for that part of the expiring web which is located downstream of the cutting line, the second contact surface being essentially in line with the first contact surface while the join is accomplished, and wherein opposite the first beam unit, which is designed to receive the new web, and on the other side of the travel path a second beam unit is provided which, on a first side is provided with a slot to let a cutting device pass through and on a second side is provided with means for receiving a bonding strip, and which is tiltable into a first position for placing a bonding strip thereon, a second position for cutting the webs and a third position for applying the bonding strip to the webs.

22. Apparatus according to claim 21, wherein the first beam unit is provided, on a second side, with means for receiving a bonding strip and is tiltable into a first position for placing a bonding strip thereon, a second position for placing the new web and a third position for cutting the webs.

23. Apparatus for joining, while stationary, an expiring web which undergoes a treatment or processing downstream of the apparatus to a new web, in such a way that, when they are joined, the webs lie in one plane, which apparatus at least comprises a travel path for the expiring web and, at least on one side of the travel path, a first beam unit which extends at least over the width of the expiring web, a part of the new web and a part of the expiring web being brought together abreast of the first beam unit, whereupon the two webs brought together are simultaneously cut through along one cutting line, and on at least one side of the webs a bonding strip being applied in order to join the webs, and the first beam unit having a first side which, at least during the cutting for a part, located upstream of the cutting line, of the new web forms a first contact surface, and the apparatus being provided with means for receiving a part, located downstream of the cutting line, of the new web, and with a second contact surface for that part of the expiring web which is located downstream of the cutting line, wherein the means for receiving that part of the new web which is located downstream of the cutting line are positioned in such a way that that part of the new web which is located downstream of the cutting line is situated, at least during cutting, at least in an area near the cutting line, at a distance from that part of the expiring web which is located downstream of the cutting line, and the apparatus is provided, on the same side of the travel path as the first beam unit, with a contact element which comprises the second contact surface for that part of the expiring web which is located downstream of the cutting line, the second contact surface being essentially in line with the first contact surface while the join is accomplished, and wherein there is disposed within the first beam unit a cutting device, which comprises at least a head with a rotatable round knife blade which, on the first side of the first beam unit, partially projects outwards through a slot, and a drive mechanism which moves the head in a sliding motion along the cutting line, and wherein the first beam unit is provided, on a second side, with means for receiving a bonding strip and with a slot for letting a cutting device pass through, and in that a second beam unit whose construction is identical to that of the first beam unit is present opposite the first beam unit on the other side of the travel path, and both beam units are tiltable into a first position for placing a bonding strip thereon, a second position for placing the new web and a third position for cutting the webs.

24. Apparatus for joining, while stationary, an expiring web which undergoes a treatment or processing downstream of the apparatus to a new web, in such a way that, when they are joined, the webs lie in one plane, which apparatus at least comprises a travel path for the expiring web and, at least on one side of the travel path, a first beam unit which extends at least over the width of the expiring web, a part of the new web and a part of the expiring web being brought together abreast of the first beam unit, whereupon the two webs brought together are simultaneously cut through along one cutting line, and on at least one side of the webs a bonding strip being applied in order to join the webs, and the first beam unit having a first side which, at least during the cutting for a part, located upstream of the cutting line, of the new web forms a first contact surface, and the apparatus being provided with means for receiving a part, located downstream of the cutting line, of the new web, and with a second contact surface for that part of the expiring web which is located downstream of the cutting line, wherein the means for receiving that part of the new web which is located downstream of the cutting line are positioned in such a way that that part of the new web which is located downstream of the cutting line is situated, at least during cutting, at least in an area near the cutting line, at a distance from that part of the expiring web which is located downstream of the cutting line, and the apparatus is provided, on the same side of the travel path as the first beam unit, with a contact element which comprises the second contact surface for that part of the expiring web which is located downstream of the cutting line, the second contact surface being essentially in line with the first contact surface while the join is accomplished, and wherein the apparatus is provided with a mechanism which is able to move the beam unit from a working position in which the join is accomplished to a preparatory position for placing a bonding strip and/or placing a new web, the preparatory position being upstream of the working position.

* * * * *